United States Patent [19]

Shikano et al.

[11] Patent Number: 4,917,276

[45] Date of Patent: Apr. 17, 1990

[54] SLIDING GATE NOZZLE FOR SPECIAL STEEL

[75] Inventors: Hiroshi Shikano, Kitakyushu; Toshihiro Suruga, Kitakyu, both of Japan

[73] Assignee: Kurosaki Refractories Co., Ltd., Fukuoka, Japan

[21] Appl. No.: 217,500

[22] Filed: Jul. 11, 1988

[30] Foreign Application Priority Data

Jul. 15, 1987 [JP] Japan ..... 62-177823

[51] Int. Cl.[4] ..... B22D 41/08

[52] U.S. Cl. ..... 222/600; 222/597

[58] Field of Search ..... 266/236, 287; 222/600, 222/591, 597; 501/99, 103

[56] References Cited

U.S. PATENT DOCUMENTS 4,386,765 6/1983 Roberts et al. ..... 266/287
4,720,083 1/1988 Zverina et al. ..... 266/287

FOREIGN PATENT DOCUMENTS 0467857 5/1971 Japan .
6077162 9/1983 Japan .
59-61567 7/1984 Japan .
2066802 7/1981 United Kingdom ..... 501/99

*Primary Examiner*—S. Kastler
*Attorney, Agent, or Firm*—Jordan and Hamburg

[57] ABSTRACT

Erosion or corrosion that has been caused during pouring a molten steel through a sliding gate nozzle for continuous casting becomes very serious when a specially treated molten steel such as deoxidized steel with a Ca alloy is applied for continuous casting. Such erosion can be eliminated by partially arranging a zirconia base refractory material on a portion of the inner surface of the nozzle hole. The zirconia base refractory material is composed of more than 53% by weight of partially stabilized zirconia base refractory material having less than 10 mesh grain size, 1 to 7% by weight of metallic silicon powder having less than 100 mesh grain size and 3 to 10% by weight of carbon powder.

5 Claims, 1 Drawing Sheet

SLIDING GATE NOZZLE FOR SPECIAL STEEL

BACKGROUND OF THE INVENTION

1. Field of the Invention

The present invention relates to a sliding gate nozzle showing stable durability in use for special steel, particularly Ca alloy-deoxidized steels.

2. Prior Art

As a plate for a sliding gate nozzle for controlling a molten steel flow in continuous casting of molten steel, alumina-carbon refractories have been used widely in recent years to prevent fuming due to pitch, which has conventionally been used in the plate, in order to achieve higher durability and service environments.

However, with the increasing demand for steels of higher quality, the addition of special alloys to molten steel and chemical treatments of the molten steel have come into practice, which has led to severe corrosion of the plate for the sliding gate nozzle at the sliding surface of the upper plate, particularly when molten steel deoxidized with Ca alloy is applied thereto.

To cope with this problem, use of zirconia-based materials has been proposed, as for instance disclosed in Japanese Patent Application Kokai Nos. 60-77162, 46-7857 and 59-61567.

A sliding gate nozzle plate of a zirconia-based material, however, lacks stability in spalling resistance and, therefore, does not promise satisfactory durability of the sliding gate nozzle for receiving a melt of special steel, particularly a molten steel deoxidized with Ca alloy.

Figure 1:
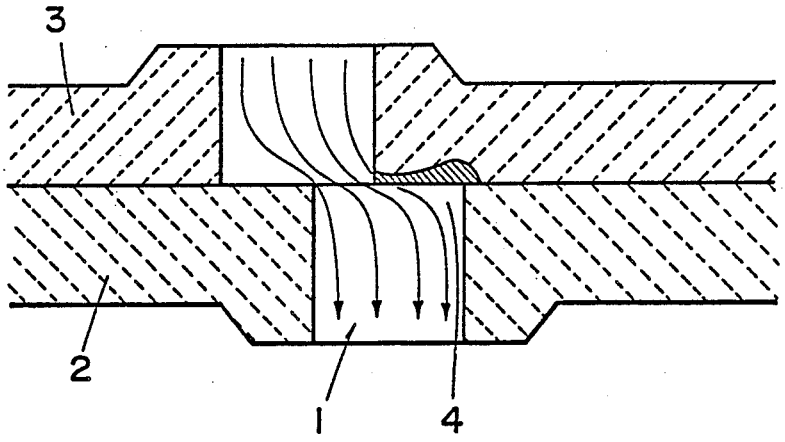
FIG. 1 illustrates of an assumed mechanism of corrosion of a sliding nozzle plate at the sliding surface when a melt of a Ca alloy-deoxidized steel is received by the sliding nozzle plate.
Figure 2:
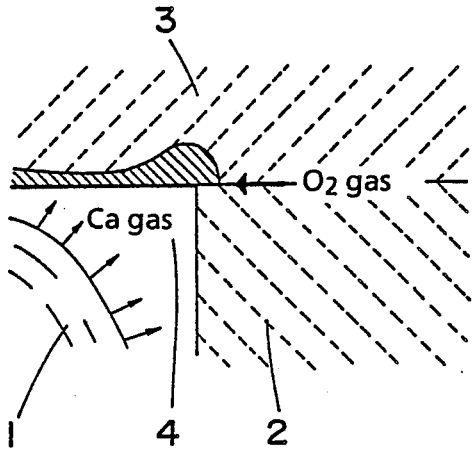
FIG. 2 is an enlarged view of a major portion of FIG. 1.

Corrosion of the plate of a sliding gate nozzle is caused by the mechanism illustrated in FIGS. 1 and 2.

First, referring to FIG. 1, when molten steel is received, a lower plate 2 slides to carry out restricted pouring for the purpose of controlling the molten steel flow 1. At that time, the molten steel flow 1 forms a negative-pressure space 4 caused by the flow 1 in a cavity portion of an upper plate 3. FIG. 2 shows the condition of erosion due to formation of a reactive gas in the space 4. Referring to the figure, Ca is liberated from the molten steel as a gas due to its low boiling point and reacts with an $O_2$ gas penetrating between the upper plate 2 and the lower plate 3, to form CaO. The CaO thus formed chemically reacts with plate components to form a low melting point substance based on, for example, $Al_2O.SiO_2.CaO$ or $Al_2O_3.CaO$, thereby causing local corrosion of the plate, particularly at the sliding surface of the upper plate 3. Consequently, the corrosion consists mainly of damage to the structure of the refractory at the sliding surface, rather than enlargement of the aperture of the nozzle hole in the plate.

According to the present invention, a zirconia refractory having a specified composition is applied at least to the part where the local corrosion would otherwise take place.

As a countermeasure against the corrosion phenomenon, attempts have been made to prevent the chemical corrosion by increasing the amount of the pitch carbon component or to improve the durability of the plate by forming the plate from a based material such as MgO. The attempt to prevent the chemical corrosion of the sliding nozzle plate by increasing the amount of the pitch carbon component in both elements used for the plate has failed to yield satisfactory experimental results in conducted studies. On the other hand, the attempt to improve the durability of the sliding nozzle plate by forming the sliding plate itself from a basic material such as MgO has resulted in poor spalling resistance. Thus, both attempts have failed to provide a sliding gate nozzle plate with high durability.

As a countermeasure against the corrosion phenomenon, it may be contemplated to convert the negative-pressure space to a positive-pressure space. This idea, however, is difficult to realize, both on an operational basis and on a cost basis, because of the large peripheral equipment required.

Accordingly, it is an object of the present invention to provide a sliding gate nozzle comprising a sliding nozzle plate sliding surface having satisfactory corrosion resistance for receiving a Ca alloy-containing special steel, without any essential modification to the conventional construction.

SUMMARY OF THE INVENTION

According to the present invention, the above-mentioned object is attained by the use of a zirconia-carbon based material which does not form a low-melting substance with CaO formed in the negative-pressure space when the melt of a Ca-containing special steel is fed to the sliding gate nozzle and which has both spalling resistance and corrosion resistance necessary for the function of a sliding nozzle plate, at the nozzle hole and the surrounding portions.

When zirconia used for the zirconia-carbon based material is unstabilized zirconia alone, a fired body obtained has many cracks due to the strain of rapid thermal expansion at the transition point peculiar to zirconia, and the product yield is poor.

Use of completely stabilized zirconia, on the other hand, leads to conspicuous thermal expansion of the fired body, thereby probably injuring the spalling resistance.

Therefore, partially stabilized zirconia with a controlled particle size of 10 mesh or below is used.

If the particle size is greater than 10 mesh, the fired body obtained has many problems relating to surface properties and is unable to accomplish the function of a sliding nozzle plate.

The partially stabilized zirconia should be used in an amount of at least 53% by weight, from the viewpoint of spalling resistance and corrosion resistance, particularly corrosion resistance. Unstabilized zirconia may be added in an amount of up to 30% by weight, whereby the spalling resistance of the fired body is a little enhanced.

However, when the above-mentioned zirconia is used alone, firing at high temperature (1500°–1600° C.) is required, and the fired body does not have a stable high strength.

Therefore, in order to enhance the bonding of the brick structure and the strength of the brick itself, in addition to spalling resistance and corrosion resistance, by making the brick structure dense through formation of $\beta$-SiC at the time of firing and also to achieve firing at 1300° to 1500° C., 1 to 7% by weight of a metallic silicon powder and 1 to 15% by weight of a carbon powder having a particle size of 100 mesh or below are added to the zirconia.

The metallic silicon added should have a Si content of at least 85% by weight, and the carbon powder should have a fixed carbon content of at least 80% by weight. If the metallic silicon powder and the carbon powder have respective purities below the above-mentioned and have particle sizes of greater than 100 mesh, the reaction of metallic silicon and carbon will be insufficient.

A complex sliding nozzle plate with the zirconia-carbon material of the present invention adhered to and around a nozzle hole or the entire sliding surface of the plate by a refractory adhesive has excellent durability, free of the adnormal corrosion as generated in conventional alumina-carbon material at the time of receiving a melt of a special steel. Besides, the sliding nozzle plate can be produced in a high yield, without generation of cracks or the like.

DESCRIPTION OF THE PREFERRED EMBODIMENTS

The compositions of refractory powders shown in Table 1 were mixed by using an organic binder, and the resultant mixtures were subjected to molding, reductive firing (1350° C.) in coke, impregnation with pitch, and firing (1000° C.). The samples thus prepared were used to line a high frequency induction furnace, then a mixture of a Ca-containing powder and pig iron was placed in the furnace, and the temperature was rapidly raised to 1650° C. After the furnace temperature was maintained at that temperature for 3 hours the corrosion of each sample was measured to verify the corrosion resistance of each material.

TABLE 1

| Sample code | A | B | C | D | E | F | G |
|---|---|---|---|---|---|---|---|
| Refractory powder (wt. %) | | | | | | | |
| ZRM*1 | 20 | — | — | — | — | — | — |
| $Al_2O_3$ | 72 | 87 | — | 62 | 42 | 22 | 2 |
| MgO | — | — | 80 | — | — | — | — |
| $ZrO_2$ | — | — | 20 | 30 | 50 | 70 | 90 |
| Silicon | 3 | 3 | — | 3 | 3 | 3 | 3 |
| Carbon | 5 | 10 | — | 5 | 5 | 5 | 5 |
| Thermoplastic phenolic resin | *2 +5 | +5 | +5 | +5 | +5 | +5 | +5 |

Notes
*1 $Al_2O_3$—$SiO_2$—$ZrO_2$ powder
*2 in outer percentage

It is confirmed from the test results, shown in Table 2, that the zirconia-carbon materials with a zirconia content of at least 70% by weight have higher corrosion resistance compared with those of conventional magnesia-based materials.

TABLE 2

| Sample code | A | B | C | D | E | F | G |
|---|---|---|---|---|---|---|---|
| Consumption ratio (%) | 40 | 28 | 8 | 20 | 10 | 5 | 5 |

Next, taking the results shown in Table 2 into account, sliding nozzle plates with nozzle holes and the surrounding portions formed of the zirconia-carbon material according to the present invention were produced.

The compositions of refractory powders shown in Table 3 were mixed by using an organic binder to prepare the blended materials.

The sliding nozzle plate base material A was produced by molding by a friction press and the steps of reductive firing (1350° C.), impregnation with pitch, and firing (1000° C.). The quality of the products was checked.

The materials which showed favorable quality, Z2 and Z4, were adhered to the base material A by a refractory adhesive to obtain finished sliding nozzle plates.

TABLE 3

| Sample code | A | Z1 | Z2 | Z3 | Z4 | Z5 |
|---|---|---|---|---|---|---|
| Refractory powder (wt. %) | | | | | | |
| ZRM*1 | 20 | — | — | — | — | — |
| $Al_2O_3$ | 72 | 22 | — | — | — | — |
| $ZrO_2$ | — | 70 | 92 | 100 | 85 | 75 |
| Silicon | 3 | 3 | 3 | — | 5 | 5 |
| Carbon | 5 | 5 | 5 | — | 10 | 20 |
| Thermoplastic phenolic resin | +5 | +5 | +5 | +5 | +5 | +6 |
| Quality of single body after firing | | | | | | |
| Apparent porosity (%) | 7.5 | 7.3 | 8.0 | 14.5 | 7.8 | 9.2 |
| Apparent specific gravity | 3.05 | 3.50 | 3.84 | 3.85 | 3.80 | 3.64 |
| Compressive strength ($kg/cm^2$) | 1600 | 1900 | 1650 | 860 | 1480 | 1300 |
| Modulus of rupture ($kg/cm^2$) | 150 | 210 | 180 | 85 | 175 | 135 |
| Spalling test*3 | M | M | S | VS | VS | VS |
| Consumption index*4 | 100 | 90 | 70 | 125 | 75 | 90 |

Notes
*3 Three-minute immersion in molten steel (1600° C.) ⇌ air cooling, repeated three times. Rating M means medium cracking, S means slight cracking, and VS means very slight cracking.
*4 The size reduction ratio at the slag-metal interface in one-hour immersion in molten steel (1600° C.) [electric iron + blast furnace/converter slag = 1/1] sample A taken as 100 (A greater value of index indicates greater corrosion).

The sliding nozzle plates were subjected to practical furnace tests at ironworks at which Ca alloy-deoxidized steels are currently produced.

The results of the practical furnace tests are collectively shown in Table 4. The results indicate that the sliding plates according to the present invention have superior durability as compared with that of Ca alloy-deoxidized steels.

TABLE 4

| Practical furnace test plate | A alone | A.Z2 | A.Z4 |
|---|---|---|---|
| Ironworks-A Ca alloy-deoxidized steel Ca concentration: 60–90 ppm Plate hole diameter: Φ 70 | Defective stop of molten steel after one run | No abnormal consumption, no cracks, after one complete casting | No abnormal consumption, no cracks, after one complete casting |
| Residual stroke | — | 110 mm | 95 mm |
| Ironworks-B Ca alloy-deoxidized steel Ca concentration: 40–50 ppm Plate hole diameter: Φ 80 | Heavy cracking, consumption of nozzle hole edge, after one complete casing plus two receptions of common steel | Very slight cracking, no abnormal consumption, after two complete casting runs plus four receptions of common steel | Very slight cracking, no abnormal consumption, after two complete casting runs plus three receptions of common steel |

What is claimed is:

1. A sliding gate nozzle for special steel comprising an upper plate, a lower plate, and a nozzle hole extending through said upper and lower plates, said nozzle hole having an inner peripheral surface formed of a zirconia base refractory material composed of more than 53% by weight of partially stabilized zirconia having less than 10 mesh grain size, 1 to 7% by weight of metallic silicon powder having less than 100 mesh grain size, and 3 to 10% by weight carbon powder having less than 100 mesh grain size, wherein said zirconia base refractory material does not contain any $Al_2O_3$ or $SiO_2$.

2. A sliding gate nozzle as in claim 1, wherein said metallic silicon powder has a silicon content of at least 85% by weight and said carbon powder has a fixed carbon content of at least 80% by weight.

3. A sliding gate nozzle as in claim 1, wherein said zirconia base refractory material further includes up to 30% by weight unstabilized zirconia.

4. A sliding gate nozzle as in claim 1, wherein said upper and lower plates comprise opposed sliding surfaces adjacent said nozzle hole and wherein at least a part of the sliding surface of said upper plate is formed of said zirconia base refractory material.

5. A sliding gate nozzle for Ca-alloy deoxidized steel comprising an upper plate, a lower plate, and a nozzle hole extending through said upper and lower plates, said nozzle hole having an inner peripheral surface formed of a zirconia base refractory material composed of more than 53% by weight of partially stabilized zirconia having less than 10 mesh grain size, 1 to 7% by weight of metallic silicon powder having less than 100 mesh grain size, and 3 to 10% by weight carbon powder having less than 100 mesh grain size, wherein said zirconia base refractory material does not contain any $Al_2O_3$ or $SiO_2$.

* * * * *